US012188338B2

(12) United States Patent
Lin et al.

(10) Patent No.: US 12,188,338 B2
(45) Date of Patent: Jan. 7, 2025

(54) MICROWAVE DRILL BIT CAPABLE OF ACHIEVING FRACTURING OF BOREHOLE WALL AND END OF DEEP HARD ROCK WHILE DRILLING AND USE METHOD THEREOF

(71) Applicant: Northeastern University, Shenyang (CN)

(72) Inventors: Feng Lin, Shenyang (CN); Xiating Feng, Shenyang (CN); Chengxiang Yang, Shenyang (CN); Jiuyu Zhang, Shenyang (CN); Shiping Li, Shenyang (CN); Tianyang Tong, Shenyang (CN); Xiangxin Su, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 18/260,454

(22) PCT Filed: Apr. 21, 2023

(86) PCT No.: PCT/CN2023/089657
§ 371 (c)(1),
(2) Date: Jul. 5, 2023

(87) PCT Pub. No.: WO2024/164433
PCT Pub. Date: Aug. 15, 2024

(65) Prior Publication Data

US 2024/0376810 A1 Nov. 14, 2024

(30) Foreign Application Priority Data

Feb. 10, 2023 (CN) ..... 202310093090.2

(51) Int. Cl.
*E21B 43/26* (2006.01)
*E21B 7/15* (2006.01)

(52) U.S. Cl.
CPC ..... *E21B 43/26* (2013.01); *E21B 7/15* (2013.01)

(58) Field of Classification Search
CPC ..... E21B 43/26; E21B 7/15
(Continued)

(56) References Cited

U.S. PATENT DOCUMENTS 4,613,812 A * 9/1986 Gelston, II ..... B23B 49/001 324/636
7,562,707 B2 * 7/2009 Miller ..... C10G 1/02 166/302

(Continued)

FOREIGN PATENT DOCUMENTS

CN 213297818 U 5/2021
CN 113090268 A 7/2021

(Continued)

*Primary Examiner* — William D Hutton, Jr.
*Assistant Examiner* — Ashish K Varma
(74) *Attorney, Agent, or Firm* — MUNCY, GEISSLER, OLDS & LOWE, P.C.

(57) ABSTRACT

A microwave drill bit capable of achieving fracturing of a borehole wall and end of a deep hard rock while drilling and a use method thereof are provided. The microwave drill bit comprises a microwave drill bit body, wherein a support frame front plate, a metal sleeve and a water inlet ring sequentially sleeve on the microwave drill bit body, the metal sleeve is connected with a rotary drive I mounted on the support frame front plate, the microwave drill body is connected with a microwave mode converter and a microwave splitter II respectively, the microwave mode converter and the microwave splitter II are connected with a microwave splitter I by a rectangular waveguide, the microwave splitter I is sequentially connected with a microwave rotating joint, a fixed waveguide and a microwave generator, and
(Continued)

the microwave rotating joint is connected with a rotary drive II mounted on the support frame rear plate.

8 Claims, 7 Drawing Sheets

(58) Field of Classification Search
USPC ..... 166/272.2
See application file for complete search history.

(56) References Cited

U.S. PATENT DOCUMENTS

| | | | | |
|---|---|---|---|---|
| 11,333,571 | B2 * | 5/2022 | Wang | G01M 3/025 |
| 2014/0008968 | A1 * | 1/2014 | Moeny | E21B 7/15 307/106 |
| 2016/0265305 | A1 * | 9/2016 | Davies | E21B 33/1204 |

FOREIGN PATENT DOCUMENTS

| | | | |
|---|---|---|---|
| CN | 113107517 | A | 7/2021 |
| CN | 113982620 | A | 1/2022 |
| CN | 115290752 | A | 11/2022 |
| CN | 115506716 | A | 12/2022 |

* cited by examiner

MICROWAVE DRILL BIT CAPABLE OF ACHIEVING FRACTURING OF BOREHOLE WALL AND END OF DEEP HARD ROCK WHILE DRILLING AND USE METHOD THEREOF

BACKGROUND OF THE INVENTION

1. Field of the Invention

The present disclosure relates to the technical field of geotechnical engineering and mining engineering, and particularly relates to a microwave drill bit capable of achieving fracturing of a borehole wall and end of a deep hard rock while drilling, and a use method thereof.

2. The Prior Arts

Rockburst refers to the phenomenon that elastic deformation potential energy accumulated in a stress concentration region of underground engineering rock masses is released suddenly under the conditions of excavation and other disturbances, which leads to burst and ejection of surrounding rocks to a free direction. Especially, with development of underground engineering towards deep areas, a geostress level is continuously increased, the geological environment of rock mass occurrence is more complex, and hazards caused by the rockburst are more severe, so that stress release is needed for a high stress region to reduce the rockburst risk. At present, a common stress release method is to drill boreholes in the high stress region. However, dust and noise can also be generated due to large workload of borehole drilling, which does not meet the requirements of environmental protection: next, improper design of borehole drilling parameters can result in a difficult control over the stress release effect: if the drilled boreholes are excessive, the strength of the surrounding rocks is difficult to guarantee; and if the drilled boreholes are less, the stress release effect is poor.

A microwave hardrock fracturing technology, as a novel highly-potential stress release technology, has the advantages of environmental protection and precise fracturing. The method comprises the steps of firstly, drilling a borehole by a common drill, then, removing a drill rod, inserting an in-hole microwave coaxial heater into the borehole, emitting microwaves to the wall periphery of the borehole, generating many cracks in the wall periphery of the drilled borehole, and obtaining the desired stress release effect according to the applied microwave power and time, thereby greatly improving the stress release effect in the rock mass. However, the method has some shortcomings: first, the drilling speed of a conventional drill for the hard rock is low: second, a working procedure is added compared with conventional drilling for stress release: third, there is a problem that the size of the borehole drilled firstly is mismatched with that of the in-hole microwave coaxial heater inserted subsequently, if the diameter of the borehole is too small or the borehole is not straight, the in-hole microwave coaxial heater cannot be inserted into the borehole; and if the diameter of the borehole is too large, the fracturing efficiency can be affected.

Therefore, it is urgent to develop an equipment capable of achieving synchronous operations of drilling and stress release, and besides, synchronous fracturing of the hard rock at the front end of the borehole can be achieved to improve the drilling efficiency, so that the problems of complex working procedures, borehole size mismatching and low drilling speed of the hard rock of the microwave stress release technology are solved, and popularization and application of the microwave stress release technology in engineering are achieved.

SUMMARY OF THE INVENTION

The present disclosure aims to provide a microwave drill bit capable of achieving fracturing of a borehole wall and end of a deep hard rock while drilling, and a use method thereof, and therefore stress release can be realized through rock mass fracture of a borehole wall while quick drilling of a hard rock.

The microwave drill bit capable of achieving fracturing of a borehole wall and end of a deep hard rock while drilling comprises a microwave drill bit body, wherein a support frame front plate, a metal sleeve and a water inlet ring sequentially sleeve on the microwave drill bit body from back to front: an outer wall of the metal sleeve is connected with a transmission gear of a rotary drive I mounted on the support frame front plate by a gear ferrule, and the metal sleeve is in contact with an end surface of the support frame front plate by a rolling steel ball; a rear end of the microwave drill bit body is connected with a microwave mode converter and a microwave splitter II respectively, and the microwave mode converter is connected with a microwave output end I of a microwave splitter I by a rectangular waveguide: the microwave mode converter enables microwaves to be transmitted from the rectangular waveguide to a rigid coaxial waveguide; the microwave splitter II is connected with the microwave output end II of the microwave splitter I by the rectangular waveguide: a microwave input end I of the microwave splitter I is connected with one end of a microwave rotating joint, and another end of the microwave rotating joint is connected with one end of a fixed waveguide: another end of the fixed waveguide is connected with a microwave generator mounted on an equipment moving platform, and the microwave rotating joint is located in a through hole in a top of a support frame rear plate, and rotates in the through hole of the support frame rear plate: an outer wall of the microwave rotating joint is connected with a transmission gear of a rotary drive II mounted on the support frame rear plate by a gear ferrule, and the microwave rotating joint achieves a lossless rotational transmission of the microwaves from the fixed waveguide under a self-rotation condition: a bottom end of the support frame front plate and a bottom end of the support frame rear plate are fixedly mounted on the equipment moving platform, and the equipment moving platform is mounted on a fixing base by directional sliding rails: the fixing base is fixed to a ground by screws, and a reaction support seat is fixedly mounted on a right side of an upper surface of the fixing base; the support frame front plate is hingedly connected with the reaction support by two heading drives, and the heading drives penetrate through the support frame rear plate: the two heading drives are arranged symmetrically by taking the rigid coaxial waveguide as a center; and the support frame front plate is pushed forward by the heading drives through a reaction support of the reaction support seat, thereby driving the rigid coaxial waveguide to drill forward, and driving structures on the equipment moving platform to synchronously move forward.

The microwave drill bit comprises an alloy drill bit, wherein a front end of the alloy drill bit is saw-toothed and in contact with a rock mass, and a rear end of the alloy drill bit is connected with a front end of the rigid coaxial waveguide by threads: the rigid coaxial waveguide, as a drill rod, provides a pushing force: the rigid coaxial waveguide comprises a rigid coaxial waveguide outer conductor and a rigid coaxial waveguide inner conductor, the rigid coaxial waveguide outer conductor is a hollow metallic cylinder, the rigid coaxial waveguide inner conductor is a solid metallic cylinder, and the rigid coaxial waveguide inner conductor is coaxially mounted in the rigid coaxial waveguide outer conductor: a gap is formed between the rigid coaxial waveguide outer conductor and the rigid coaxial waveguide inner conductor, and the microwaves are transmitted through the gap between the rigid coaxial waveguide outer conductor and the rigid coaxial waveguide inner conductor; and a rear end of the rigid coaxial waveguide outer conductor is connected with the microwave mode converter.

Two through holes are axially drilled in the rigid coaxial waveguide inner conductor, and symmetrically arranged along a section center of the rigid coaxial waveguide inner conductor; soft coaxial waveguides are mounted in the two through holes respectively, and a diameter of each soft coaxial waveguide is smaller than a radius of the rigid coaxial waveguide inner conductor; front ends of the soft coaxial waveguides penetrate through the rigid coaxial waveguide inner conductor and the alloy drill bit to be connected with a microwave radiator, and a ceramic sleeve fixed to an end surface of the alloy drill bit sleeves on the front end of the microwave radiator; the microwaves are transmitted through the soft coaxial waveguides to radiate the rock mass after penetrating through the ceramic sleeve, and the ceramic sleeve is transparent to the microwaves, has a height smaller than that of a cutting head, and is used to prevent drilled rock debris from entering the soft coaxial waveguides; and rear ends of the soft coaxial waveguides extend to an outer side of the rigid coaxial waveguide inner conductor, and are connected with one end of the microwave splitter II.

Three borehole wall cracks are cut in the rigid coaxial waveguide outer conductor for releasing the microwaves of the rigid coaxial waveguide into the rock mass around the borehole wall; in order to ensure an efficient cutting of an electromagnetic field by the borehole wall cracks, the borehole wall cracks and the rigid coaxial waveguide are not axially and annularly parallel, and are arranged crosswise; and a length of the borehole wall cracks is ¼ to ½ of a wavelength of the microwaves, and a distance between two adjacent borehole wall cracks is ¼ to ½ of the wavelength.

The water inlet ring is arranged on an outer wall of the rigid coaxial waveguide, and the water inlet ring is a hollow metal sleeve without an inner wall surface; the water inlet ring is embedded on an annular groove in the outer wall of the rigid coaxial waveguide, and a connection position between the water inlet ring and the annular groove is sealed by a rubber: two round holes are formed in upper and lower ends of the water inlet ring respectively, and serve as a water outlet and a water inlet; the round holes are connected with a cooling water tank at a front end of the equipment moving platform by rigid metal water pipes, and the water inlet ring and the rigid coaxial waveguide are synchronously pushed in a horizontal direction, without rotating: the rigid coaxial waveguide is symmetrically provided with two round holes along a central plane of the annular groove, and communicates with a cooling channel drilled along the rigid coaxial waveguide outer conductor and the alloy drill bit; and a cooling water in the cooling water tank flows into the water inlet ring from the water inlet, and flows out from the water outlet to enter the cooling water tank after passing through the cooling channel.

The microwave splitter I comprises the microwave input end I and two microwave output ends, wherein the two microwave output ends are respectively the microwave output end I and the microwave output end II: the microwave input end I is divided into ten branches, nine branches are converged to the microwave output end I, and the rest branch is connected with the microwave output end II; and a transmission of the microwaves of the branches is controlled by a branch switch to achieve a power distribution of the microwave output end I and the microwave output end II, and the branch switch is an aluminum metal plate.

The microwave splitter II comprises a microwave input end II and two microwave output ends III, wherein the two microwave output ends III are connected with the soft coaxial waveguides respectively; and the microwave input end II is connected with the microwave output end II of the microwave splitter I.

A use method of the microwave drill bit capable of achieving fracturing of a borehole wall and end of a deep hard rock while drilling comprises the following steps:

Step 1: drilling a monitoring hole in a position 10-20 m from a borehole, and arranging an in-hole radar damage monitoring device in the monitoring hole, wherein the in-hole radar damage monitoring device comprises a cylindrical rod body, a radar signal sensor is arranged at a front end of the cylindrical rod body, and monitors rock mass fracture information at a distance of greater than 20 m in a hole-diameter direction and transmits the rock mass fracture information to a computer through a signal line in the cylindrical rod body, and information of cracks around the borehole at different drilling depths is measured by axially moving the radar damage monitoring device in the monitoring hole.

Step 2: selecting a blank control borehole, opening a water inlet of a cooling water, and starting the rotary drive I, the rotary drive II and the heading drives but not switching on the microwave generator, wherein a pushing speed $V_0$ and a drilling speed Ro are fixed, a curve of a pushing force $T_0$ with the drilling depth in a pushing process is monitored, and the information of the cracks around the blank control borehole is tested by the in-hole radar damage monitoring device.

Step 3: selecting a microwave borehole, opening the water inlet of the cooling water, starting the rotary drive I, the rotary drive II and the heading drives, opening ten branches of the microwave splitter I, and switching on the microwave generator, wherein a microwave power is continuously increased, and a microwave reflection power is monitored by a reflection power meter to ensure that the microwave reflection power does not exceed a critical reflection power A of the microwave drill bit, the pushing speed $V_0$ is fixed, and when the microwave power reaches a maximum value, a pushing force $T_1$ and the information of the cracks around the borehole in the pushing process are monitored.

Step 4: if the pushing force $T_1$ is less than $T_0$ at a moment, and the number of the cracks around the borehole is increased compared with that without microwaves, continuing operation under this working parameter.

Step 5: if the pushing force $T_1$ is equal to $T_0$, but the number of the cracks around the borehole is increased, switching off the microwave generator and the heading drives firstly, then closing one branch connected with the microwave output end I, so as to increase a proportion of the microwave power distributed to the microwave output end II, switching on the microwave generator and the heading drives to continuously increase the microwave power, so as to ensure that the microwave reflection power does not exceed the critical reflection power A of the microwave drill bit, monitoring the pushing force $T_1$ and the information of the cracks around the borehole, if conditions that the pushing force $T_1$ is less than $T_0$ and the number of the cracks around the borehole is increased are not met simultaneously, continuing to additionally closing one branch connected with the microwave output end I, and repeating the operation in step 5, until the pushing force $T_1$ is less than $T_0$ and the number of the cracks around the borehole is increased.

Step 6: if the conditions that the pushing force $T_1$ is less than $T_0$ and the number of the cracks around the borehole is increased are not met simultaneously under conditions in step 4 and step 5, reducing the pushing speed to ensure that an irradiation time at each point is prolonged, and repeating the operation in steps 4-6, until the conditions that the pushing force $T_1$ is less than $T_0$ and the number of the cracks around the borehole is increased are realized simultaneously.

The present invention, adopting the above technical solution, has the following benefits that:

(1) The structure of an dual-antenna microwave drill bit is adopted, and a rigid coaxial waveguide is used as a drill rod: cross borehole wall cracks are cut in a rigid coaxial waveguide outer conductor to release microwaves, and soft coaxial waveguides penetrate through an rigid coaxial waveguide inner conductor: by the above design, the effect of releasing the microwaves to fracture the rock mass from the front end of the drill bit and the side wall of the drill rod simultaneously can be achieved; the difficulty and time for drilling the deep hard rock by the drill bit are reduced greatly, and besides, high stress release effect is achieved on the side wall; and drilling work and microwave stress release which are separated from each other are integrated, thereby shortening the construction period greatly.

(2) The synchronous microwave stress release from the side wall of the drill rod is achieved as the drilling is performed, and therefore the problem that, during microwave fracturing of the borehole wall after drilling, the size of the borehole is mismatched with that of the in-hole microwave coaxial waveguide is solved: the size of the borehole perfectly fits with that of the coaxial waveguide, not only is the problem of equipment installation avoided, but also dissipation of the microwaves in air can be reduced greatly; and the microwave fracturing efficiency is improved.

(3) The power regulation of the front end of the drill bit and the side wall of the drill rod can be achieved by a switch of a branch in a power splitter, and therefore a highly-effective utilization of the microwave power is achieved.

In drawings, 1: rock mass, 2: rigid coaxial waveguide, 3: metal sleeve, 4: microwave mode converter, 5: rectangular waveguide, 6: microwave splitter II, 7: microwave splitter I, 8: microwave rotating joint, 9: reflection power meter, 10: fixed waveguide, 11: microwave generator, 12: water inlet ring, 13: cooling water tank, 14: support frame front plate, 15: rotary drive I, 16: heading drive, 17: rotary drive II, 18-support frame rear plate, 19: equipment moving platform, 20: fixing base, 21: reaction support seat, 22: alloy drill bit, 23: rigid coaxial waveguide outer conductor, 24: soft coaxial waveguide, 25: rigid coaxial waveguide inner conductor, 26: water outlet, 27: cooling channel, 28: water inlet, 29: microwave, 30: cutting head, 31: borehole wall crack, 32: groove, 33: microwave input end I, 34: branch, 35: branch switch, 36: microwave output end I, 37: microwave output end II, 38: monitoring hole, 39: in-hole radar damage monitoring device, 40: radar signal sensor, 41: crack, and 42: borehole.

DETAILED DESCRIPTION OF THE PREFERRED EMBODIMENT

The disclosure will be further described in detail with reference to the attached drawings and specific embodiments.

Figure 1:
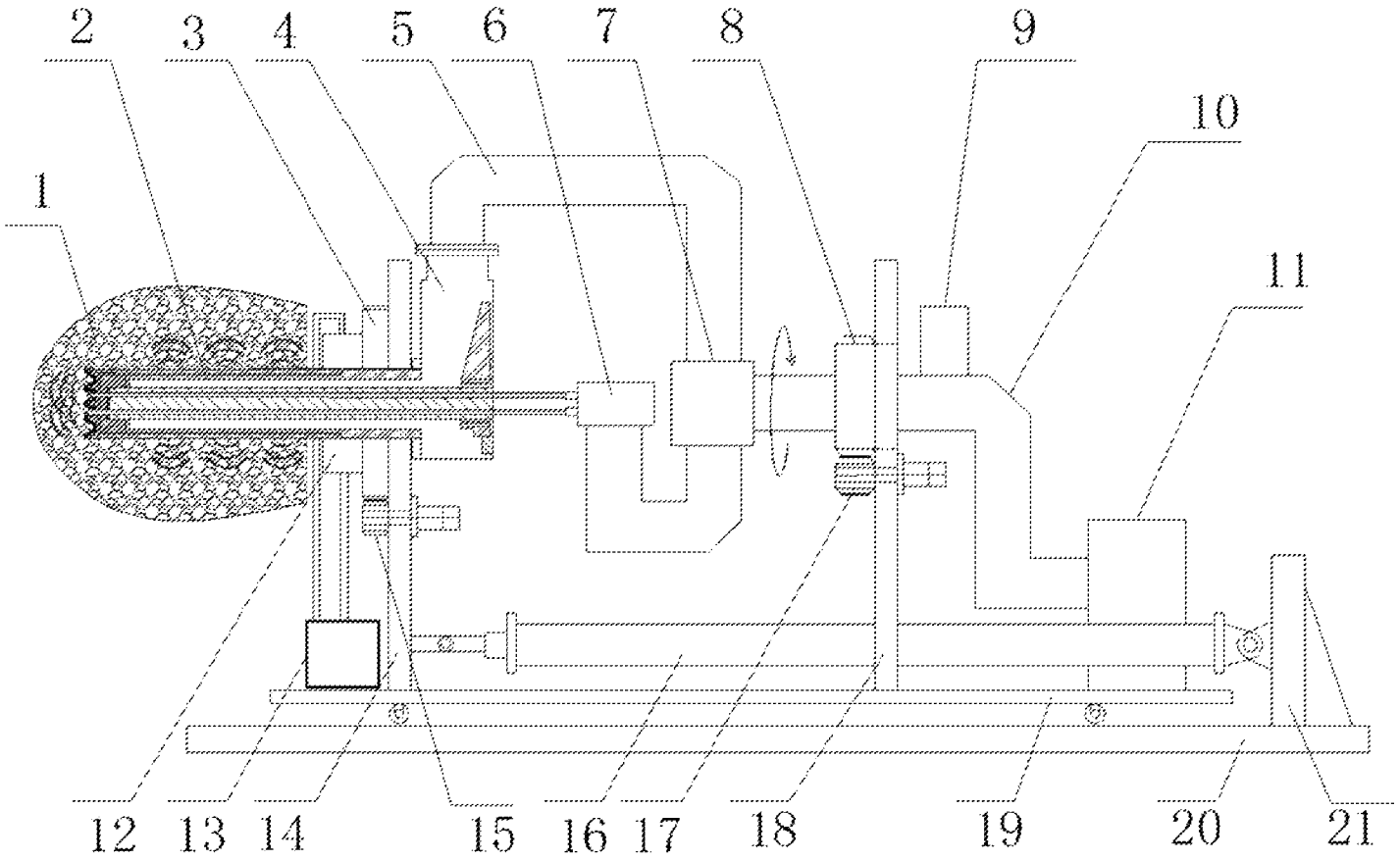
FIG. 1 is an overall structural diagram of a microwave drill bit capable of achieving fracturing of a borehole wall and end of a deep hard rock while drilling according to the present disclosure.
Figure 2:
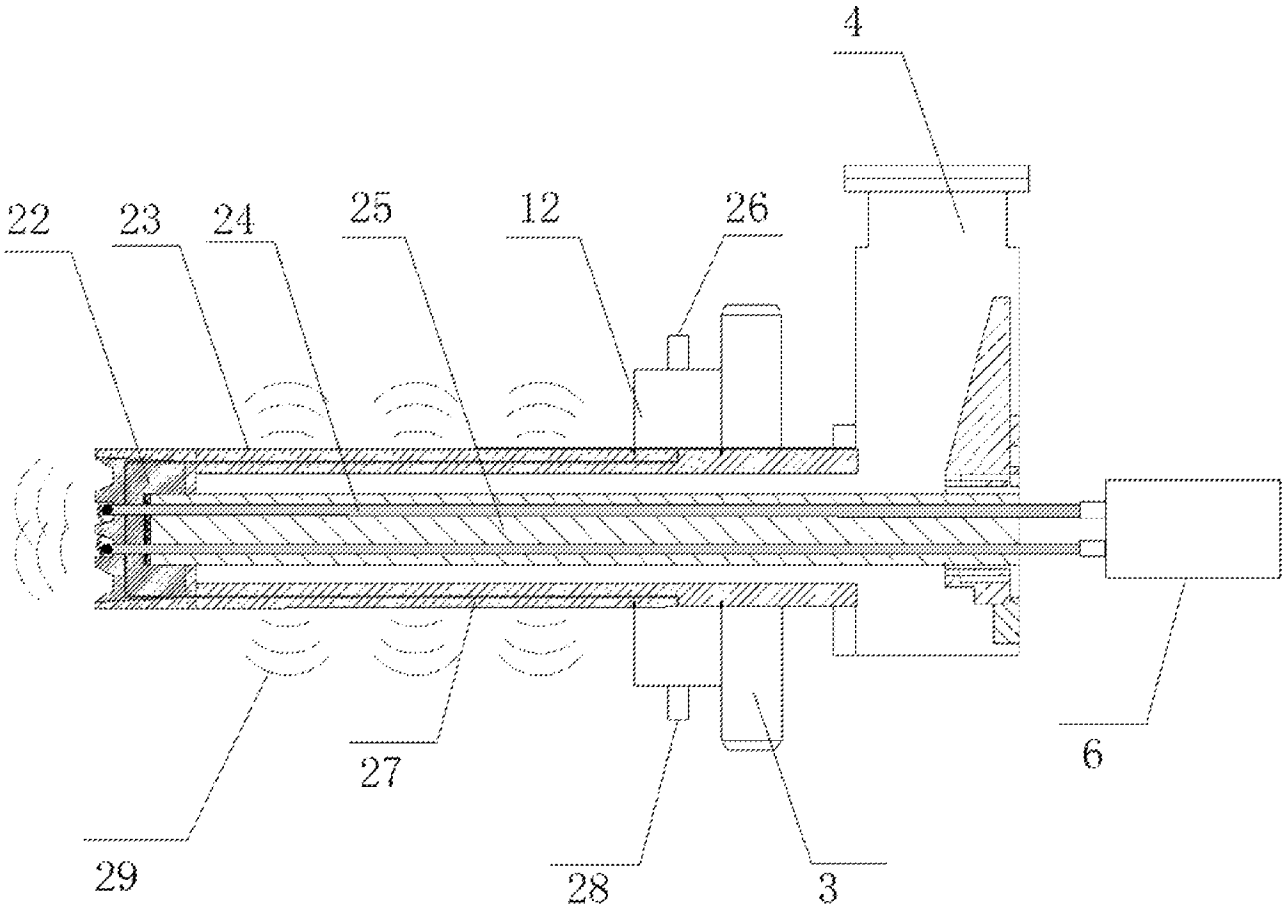
FIG. 2 is a structural diagram of a double-antenna microwave drill bit of the microwave drill bit capable of achieving fracturing of a borehole wall and end of a deep hard rock while drilling according to the present disclosure.
Figure 3:
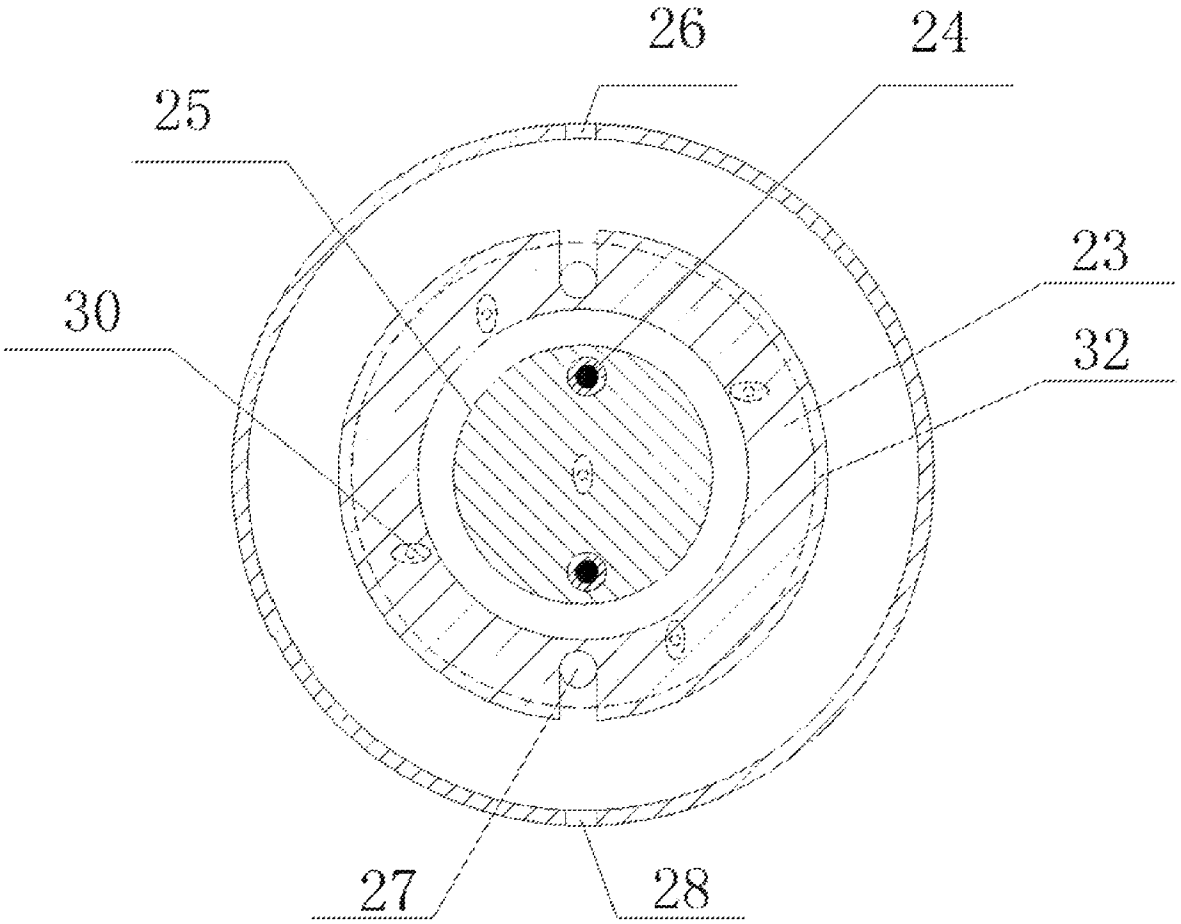
FIG. 3 is a section view of the double-antenna microwave drill bit of the microwave drill bit capable of achieving fracturing of a borehole wall and end of a deep hard rock while drilling according to the present disclosure.
Figure 4:
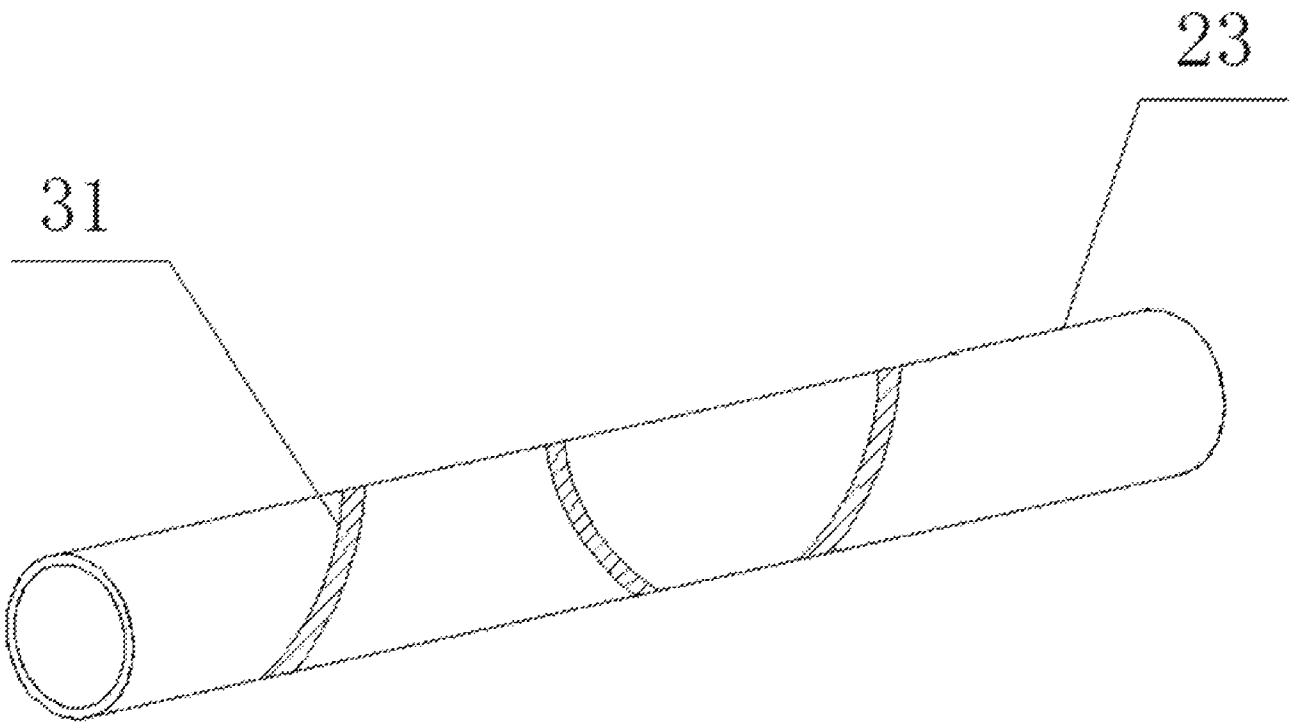
FIG. 4 is a schematic diagram of cracks of a borehole wall by the microwave drill bit capable of achieving fracturing of a borehole wall and end of a deep hard rock while drilling according to the present disclosure.
Figure 5:
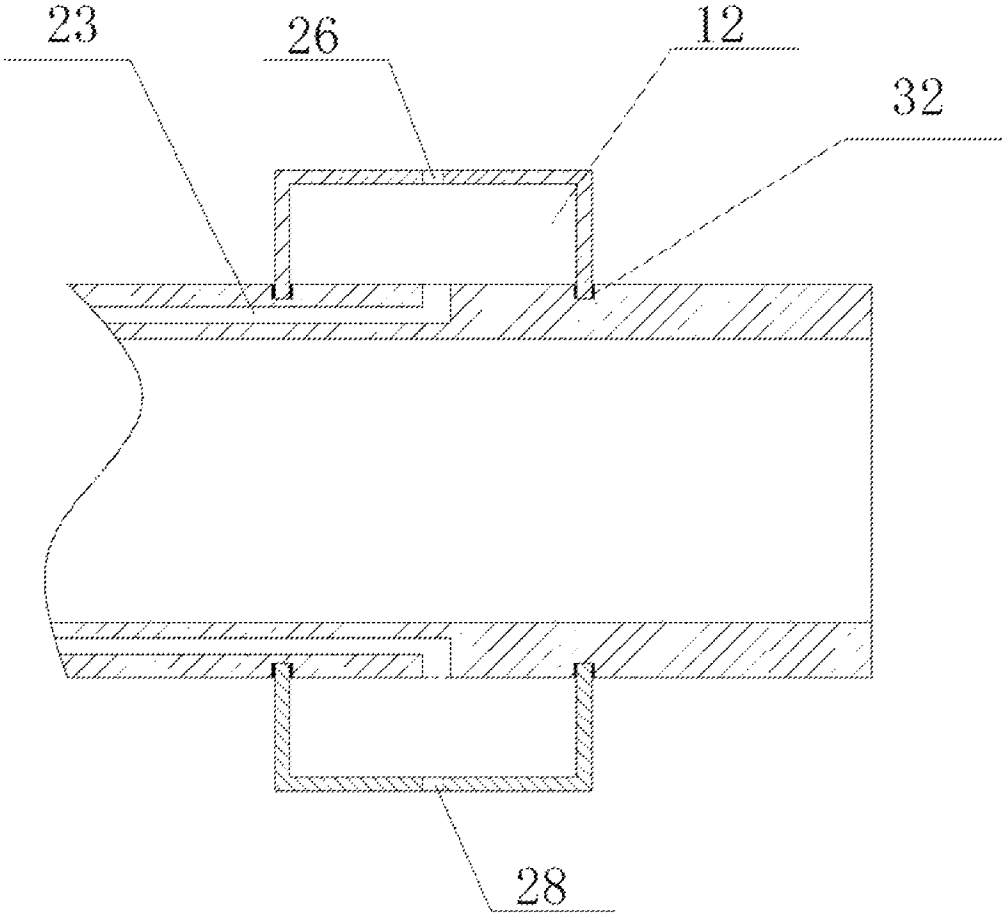
FIG. 5 is a front view of a water inlet ring of the microwave drill bit capable of achieving fracturing of a borehole wall and end of a deep hard rock while drilling according to the present disclosure.
Figure 6:
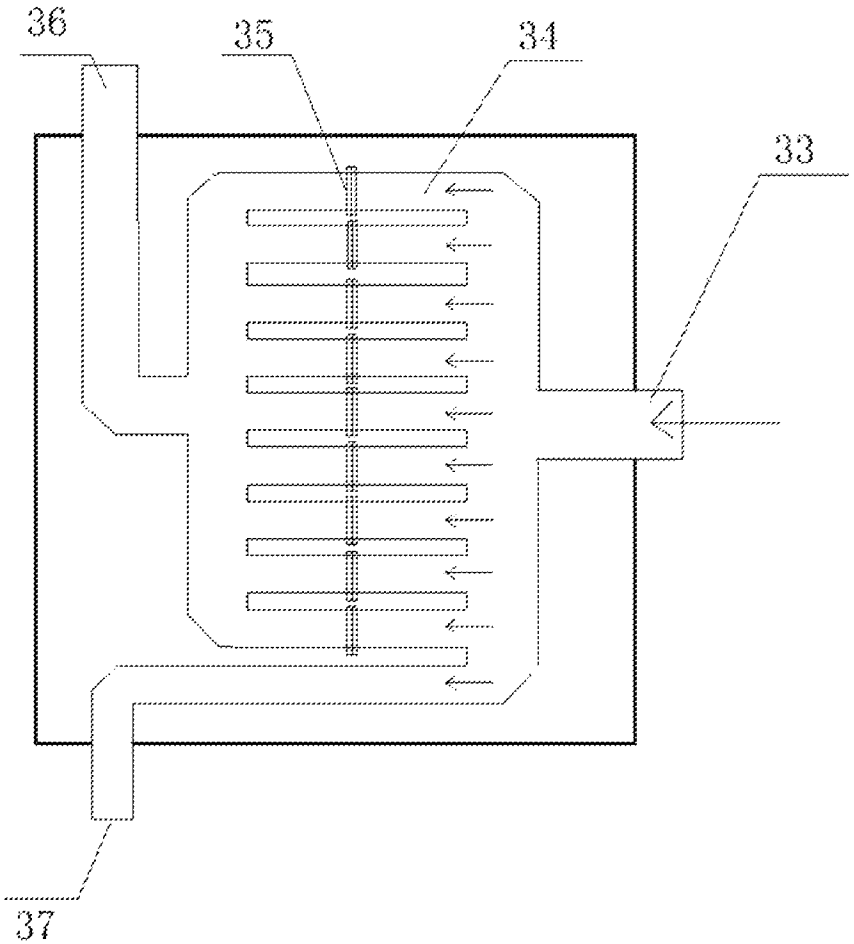
FIG. 6 is a structural diagram of a microwave splitter I of the microwave drill bit capable of achieving fracturing of a borehole wall and end of a deep hard rock while drilling according to the present disclosure.
Figure 7:
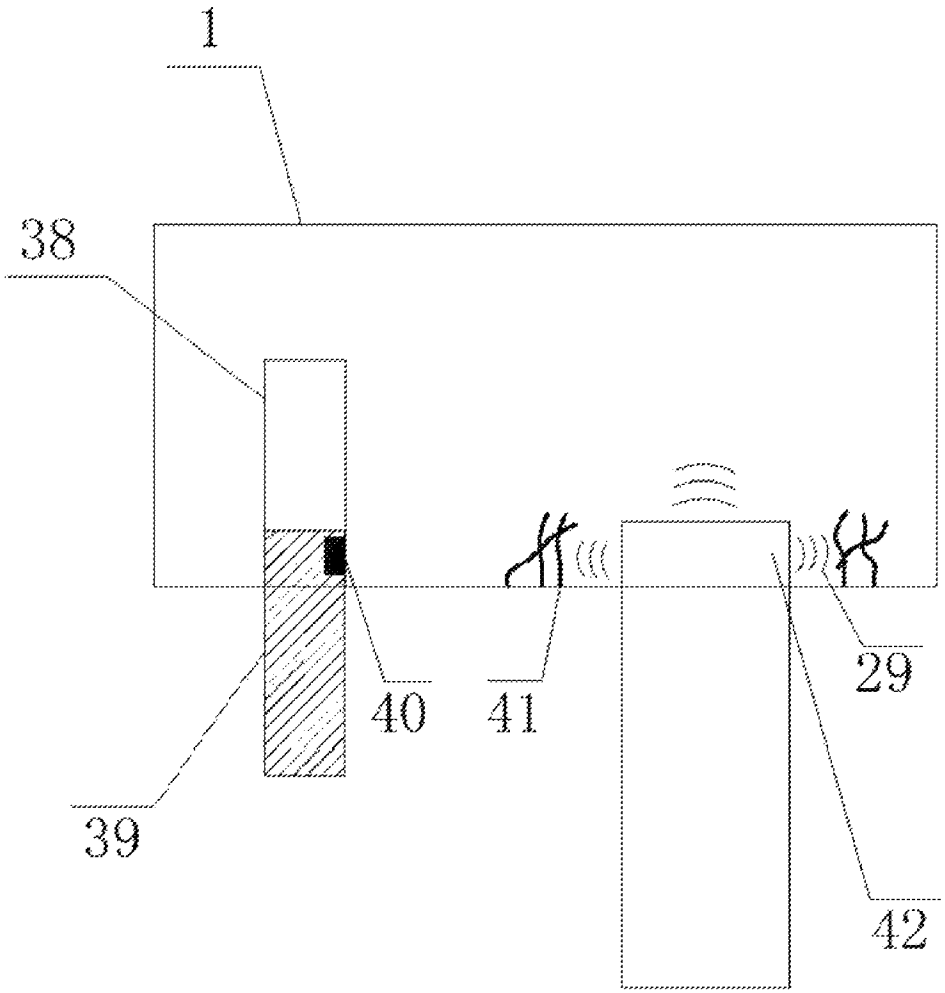
FIG. 7 is a schematic diagram of operation of the microwave drill bit capable of achieving fracturing of a borehole wall and end of a deep hard rock while drilling according to the present disclosure.

As shown in FIGS. 1 to 7, a microwave drill bit capable of achieving fracturing of a borehole wall and end of a deep hard rock while drilling comprises a microwave drill bit body, wherein a support frame front plate 14, a metal sleeve 3 and a water inlet ring 12 sequentially sleeve on the microwave drill bit body from back to front; an outer wall of the metal sleeve 3 is connected with a transmission gear of a rotary drive I 15 mounted on the support frame front plate 14 by a gear ferrule, and the metal sleeve 3 is in contact with an end surface of the support frame front plate 14 by a rolling steel ball: a rear end of the microwave drill bit body is connected with a microwave mode converter 4 and a microwave splitter II 6 respectively, and the microwave mode converter 4 is connected with a microwave output end I 36 of a microwave splitter I 7 by a rectangular waveguide 5: the microwave mode converter 4 can enable microwaves to be transmitted from the rectangular waveguide 5 to a rigid coaxial waveguide 2; the microwave splitter II 6 is connected with a microwave output end II 37 of the microwave splitter I 7 by the rectangular waveguide 5: a microwave input end I 33 of the microwave splitter I 7 is connected with one end of a microwave rotating joint 8, and another end of the microwave rotating joint 8 is connected with one end of a fixed waveguide 10; another end of the fixed waveguide 10 is connected with a microwave generator 11 mounted on an equipment moving platform 19, and the microwave rotating joint 8 is located in a through hole in a top of a support frame rear plate 18, and rotates in the through hole of the support frame rear plate 18: an outer wall of the microwave rotating joint 8 is connected with a transmission gear of a rotary drive II 17 mounted on the support frame rear plate 18 by a gear ferrule, and the microwave rotating joint 8 is allowed to achieve a lossless rotational transmission of microwaves from the fixed waveguide 10 under a self-rotation condition; bottom ends of the support frame front plate 14 and the support frame rear plate 18 are fixedly mounted on the equipment moving platform 19, and the equipment moving platform 19 is mounted on a fixing base 20 by directional sliding rails: the fixing base 20 is fixed to a ground by screws, and a reaction support seat 21 is fixedly mounted on a right side of an upper surface of the fixing base 20; the support frame front plate 14 is hingedly connected with the reaction support 21 by two heading drives 16, and the heading drives 16 penetrate through the support frame rear plate 18: the two heading drives 16 are arranged symmetrically by taking the rigid coaxial waveguide 2 as a center; and the support frame front plate 14 is pushed forward by the heading drives 16 through a reaction support of the reaction support seat 21, thereby driving the rigid coaxial waveguide 2 to drill forward, and besides, driving structures on the equipment moving platform 19 to synchronously move forward.

The microwave drill bit is a dual-antenna microwave drill bit, and comprises an alloy drill bit 22. A front end of the alloy drill bit 22 is saw-toothed and in contact with a rock mass 1, and a rear end of the alloy drill bit 22 is connected with a front end of the rigid coaxial waveguide 2 by threads: the rigid coaxial waveguide 2, as the drill rod, provides a pushing force: the rigid coaxial waveguide 2 comprises a rigid coaxial waveguide outer conductor 23 and a rigid coaxial waveguide inner conductor 25, the rigid coaxial waveguide outer conductor 23 is a hollow metallic cylinder, the rigid coaxial waveguide inner conductor 25 is a solid metallic cylinder, and the rigid coaxial waveguide inner conductor 25 is coaxially mounted in the rigid coaxial waveguide outer conductor 23: a gap is formed between the rigid coaxial waveguide outer conductor 23 and the rigid coaxial waveguide inner conductor 25, and the microwaves are transmitted through a gap between the rigid coaxial waveguide outer conductor 23 and the rigid coaxial waveguide inner conductor 25; and a rear end of the rigid coaxial waveguide outer conductor 23 is connected with the microwave mode converter 4.

Two through holes are axially drilled in the rigid coaxial waveguide inner conductor 25, and symmetrically arranged along a section center of the rigid coaxial waveguide inner conductor 25. Soft coaxial waveguides 24 are mounted in the two through holes respectively, and a diameter of each soft coaxial waveguide 24 is smaller than a radius of the rigid coaxial waveguide inner conductor 25: front ends of the soft coaxial waveguides 24 penetrate through the rigid coaxial waveguide inner conductor 25 and the alloy drill bit 22 and are connected with a microwave radiator, and a ceramic sleeve fixed to an end surface of the alloy drill bit 22 sleeves on the front end of the microwave radiator: the microwaves are transmitted through the soft coaxial waveguides 24 to radiate the rock mass 1 after penetrating through the ceramic sleeve, and the ceramic sleeve is transparent to the microwaves, has a height smaller than that of a cutting head, and is used to prevent drilled rock debris from entering the soft coaxial waveguides 24; and rear ends of the soft coaxial waveguides 24 extend to an outer side of the rigid coaxial waveguide inner conductor 25, and are connected with one end of the microwave splitter II 6.

The rigid coaxial waveguide 2 is located in the through hole in the top of the support frame front plate 14, and rotates in the through hole of the support frame front plate 14. The metal sleeve 3 with the gear ferrule is arranged on the outer wall of the rigid coaxial waveguide 2, and the inner wall of the metal sleeve 3 is fixedly connected with the rigid coaxial waveguide 2.

The rotating speeds of the rotary drive I 15 and the rotary drive II 17 are remained the same, and the metal sleeve 3 is driven to rotate by the rotary drive I 15: the microwave rotating joint 8 is driven to rotate by the rotary drive II 17 to drive the rigid coaxial waveguide 2, the soft coaxial waveguides 24, the microwave mode converter 4, the rectangular waveguide 5, and the microwave splitters I 7 and II 6 to rotate together.

Three borehole wall cracks 31 are cut in the rigid coaxial waveguide outer conductor 23 for releasing microwaves 29 of the rigid coaxial waveguide 2 into the rock mass 1 around the borehole wall. In order to ensure an efficient cutting of an electromagnetic field by the borehole wall cracks 31, the borehole wall cracks 31 and the rigid coaxial waveguide 2 are not axially and annularly parallel, and are arranged crosswise. A length of the borehole wall cracks 31 is ¼ to ½ of a wavelength of the microwaves 29, and a distance between two adjacent borehole wall cracks 31 is ¼ to ½ of the wavelength.

The water inlet ring 12 is arranged on an outer wall of the rigid coaxial waveguide 2, and the water inlet ring 12 is a hollow metal sleeve without an inner wall surface. The water inlet ring 12 is embedded on an annular groove 32 in the outer wall of the rigid coaxial waveguide 2, and a connection position between the water inlet ring 12 and the annular groove 32 is sealed by a rubber; two round holes are formed in the upper and lower ends of the water inlet ring 12 respectively, and serve as a water outlet 26 and a water inlet 28: the round holes are connected with a cooling water tank 13 at a front end of the equipment moving platform 19 by rigid metal water pipes, and the water inlet ring 12 and the rigid coaxial waveguide 2 are synchronously pushed in a horizontal direction, but not rotated; the rigid coaxial waveguide 2 is symmetrically provided with two round holes along a central plane of the annular groove 32, and communicates with a cooling channel 27 drilled along the rigid coaxial waveguide outer conductor 23 and the alloy drill bit 22; and a cooling water in the cooling water tank 13 flows into the water inlet ring 12 from the water inlet 28, and flows out from the water outlet 26 to enter the cooling water tank 13 after passing through the cooling channel 27.

The microwave splitter I 7 comprises the microwave input end I 33 and two microwave output ends, wherein the two microwave output ends are respectively the microwave output end I 36 and the microwave output end II 37: the microwave input end I 33 is divided into ten branches 34, nine branches 34 are converged to the microwave output end I 36, and the rest branch 34 is connected with the microwave output end II 37; and a transmission of microwaves of the branches 34 is controlled by a branch switch 35 to achieve a power distribution of the microwave output end I 36 and the microwave output end II 37, and the branch switch 35 is an aluminum metal plate.

The microwave splitter II 6 comprises a microwave input end II and two microwave output ends III, wherein the two microwave output ends III are connected with the soft coaxial waveguides 24 respectively; and the microwave input end II is connected with the microwave output end II 37 of the microwave splitter I 7.

A use method of the microwave drill bit capable of achieving fracturing of a borehole wall and end of a deep hard rock while drilling comprises the following steps:

Step 1: drilling a monitoring hole 38 with a depth of Lim and a diameter of 50 cm in a position 10-20 m from a borehole 42, and arranging an in-hole radar damage monitoring device 39 in the monitoring hole 38, wherein the in-hole radar damage monitoring device 39 comprises a cylindrical rod body, a radar signal sensor 40 is arranged at a front end of the cylindrical rod body, and can monitor rock mass fracture information at a distance of greater than 20 m in a hole-diameter direction and transmit the rock mass fracture information to a computer through a signal line in the cylindrical rod body, and information of cracks 41 around the borehole 42 at different drilling depths can be measured by axially moving the radar damage monitoring device 39 in the monitoring hole 38.

Step 2: selecting a blank control borehole 42, opening the water inlet 28 of the cooling water, and starting the rotary drive I 15, the rotary drive II 17 and the heading drives 16 but not switching on the microwave generator 11, wherein a pushing speed $V_0$ and a drilling speed Ro are fixed, the pushing speed $V_0$ and the drilling speed Ro are selected from common parameters for the deep hard rock, a drilling depth is $L_2$ m, the drilling depth $L_2$ is smaller than the depth $L_1$ of the monitoring hole 38, a curve of a pushing force $T_0$ with the drilling depth in a pushing process is monitored, and the information of the cracks 41 around the blank control borehole is tested by the in-hole radar damage monitoring device 39.

Step 3: selecting a microwave borehole 42, opening the water inlet 28 of the cooling water, starting the rotary drive I 15, the rotary drive II 17 and the heading drives 16, opening ten branches 34 of the microwave splitter I 7, and besides, switching on the microwave generator 11, wherein a microwave power is continuously increased, and a microwave reflection power is monitored by a reflection power meter 9 to ensure that the microwave reflection power does not exceed a critical reflection power A of the microwave drill bit, the pushing speed $V_0$ is fixed, and when the microwave power reaches a maximum value, a pushing force $T_1$ and the information of the cracks 41 around the borehole 42 in the pushing process are monitored.

Step 4: if the pushing force $T_1$ is less than $T_0$ at the moment, and a number of the cracks 41 around the borehole 42 is increased compared with that without microwaves, continuing operation under this working parameter.

Step 5: if the pushing force $T_1$ is equal to $T_0$, but the number of the cracks 41 around the borehole 42 is increased, switching off the microwave generator 11 and the heading drives 16 firstly, then closing one branch 34 connected with the microwave output end I 36, so as to increase a proportion of the microwave power distributed to the microwave output end II 37, switching on the microwave generator 11 and the heading drives 16 to continuously increase the microwave power, so as to ensure that the microwave reflection power does not exceed the critical reflection power A of the microwave drill bit, monitoring the pushing force $T_1$ and the information of the cracks 41 around the borehole 42, if the condition that the pushing force $T_1$ is less than $T_0$ and the condition that the number of the cracks 41 around the borehole 42 is increased cannot be met simultaneously, continuing to additionally closing one branch 34 connected with the microwave output end I 36, and repeating the operation in the step 5, until the pushing force $T_1$ is less than $T_0$ and the number of the cracks 41 around the borehole 42 is increased.

Step 6: if the conditions that the pushing force $T_1$ is less than $T_0$ and the number of the cracks 41 around the borehole 42 is increased cannot be met simultaneously under the conditions in the step 4 and step 5, reducing the pushing speed to ensure that an irradiation time at each point is prolonged, and repeating the operation in the steps 4-6, until the pushing force $T_1$ is less than $T_0$ and the number of the cracks 41 around the borehole 42 is increased.

What is claimed is:

1. A microwave drill bit capable of achieving fracturing of a borehole wall and end of a deep hard rock while drilling, comprising a microwave drill bit body, wherein a support frame front plate, a metal sleeve and a water inlet ring sequentially sleeve on the microwave drill bit body from back to front;

an outer wall of the metal sleeve is connected with a transmission gear of a rotary drive I mounted on the support frame front plate by a gear ferrule, and the metal sleeve is in contact with an end surface of the support frame front plate by a rolling steel ball;

a rear end of the microwave drill bit body is connected with a microwave mode converter and a microwave splitter II respectively, and the microwave mode converter is connected with a microwave output end I of a microwave splitter I by a rectangular waveguide;

the microwave mode converter enables microwaves to be transmitted from the rectangular waveguide to a rigid coaxial waveguide;

the microwave splitter II is connected with a microwave output end II of the microwave splitter I by the rectangular waveguide;

a microwave input end I of the microwave splitter I is connected with one end of a microwave rotating joint, and another end of the microwave rotating joint is connected with one end of a fixed waveguide;

another end of the fixed waveguide is connected with a microwave generator mounted on an equipment moving platform, and the microwave rotating joint is located in a through hole in a top of a support frame rear plate, and rotates in the through hole of the support frame rear plate;

an outer wall of the microwave rotating joint is connected with a transmission gear of a rotary drive II mounted on the support frame rear plate by a gear ferrule, and the microwave rotating joint achieves a lossless rotational transmission of the microwaves from the fixed waveguide under a self-rotation condition;

a bottom end of the support frame front plate and a bottom end of the support frame rear plate are fixedly mounted on the equipment moving platform, and the equipment moving platform is mounted on a fixing base by directional sliding rails;

the fixing base is fixed to a ground by screws, and a reaction support seat is fixedly mounted on a right side of an upper surface of the fixing base;

the support frame front plate is hingedly connected with the reaction support seat by two heading drives, and the heading drives penetrate through the support frame rear plate;

the two heading drives are arranged symmetrically by taking the rigid coaxial waveguide as a center; and the support frame front plate is pushed forward by the heading drives through a reaction support of the reaction support seat, thereby driving the rigid coaxial waveguide to drill forward, and driving structures on the equipment moving platform to synchronously move forward.

2. The microwave drill bit according to claim 1, further comprising an alloy drill bit, wherein a front end of the alloy drill bit is saw-toothed and in contact with a rock mass, and a rear end of the alloy drill bit is connected with a front end of the rigid coaxial waveguide by threads;

the rigid coaxial waveguide, as a drill rod, provides a pushing force;

the rigid coaxial waveguide comprises a rigid coaxial waveguide outer conductor and a rigid coaxial waveguide inner conductor, the rigid coaxial waveguide outer conductor is a hollow metallic cylinder, the rigid coaxial waveguide inner conductor is a solid metallic cylinder, and the rigid coaxial waveguide inner conductor is coaxially mounted in the rigid coaxial waveguide outer conductor;

a gap is formed between the rigid coaxial waveguide outer conductor and the rigid coaxial waveguide inner conductor, and the microwaves are transmitted through the gap between the rigid coaxial waveguide outer conductor and the rigid coaxial waveguide inner conductor; and a rear end of the rigid coaxial waveguide outer conductor is connected with the microwave mode converter.

3. The microwave drill bit according to claim 2, wherein two through holes are axially drilled in the rigid coaxial waveguide inner conductor, and symmetrically arranged along a section center of the rigid coaxial waveguide inner conductor;

soft coaxial waveguides are mounted in the two through holes respectively, and a diameter of each soft coaxial waveguide is smaller than a radius of the rigid coaxial waveguide inner conductor;

front ends of the soft coaxial waveguides penetrate through the rigid coaxial waveguide inner conductor and the alloy drill bit to be connected with a microwave radiator, and a ceramic sleeve fixed to an end surface of the alloy drill bit sleeves on the front end of the microwave radiator;

the microwaves are transmitted through the soft coaxial waveguides to radiate the rock mass after penetrating through the ceramic sleeve, and the ceramic sleeve is transparent to the microwaves, has a height smaller than that of a cutting head, and is used to prevent drilled rock debris from entering the soft coaxial waveguides; and rear ends of the soft coaxial waveguides extend to an outer side of the rigid coaxial waveguide inner conductor, and are connected with one end of the microwave splitter II.

4. The microwave drill bit according to claim 3, wherein three borehole wall cracks are cut in the rigid coaxial waveguide outer conductor for releasing the microwaves of the rigid coaxial waveguide into the rock mass around the borehole wall;

in order to ensure an efficient cutting of an electromagnetic field by the borehole wall cracks, the borehole wall cracks and the rigid coaxial waveguide are not axially and annularly parallel, and are arranged crosswise; and a length of the borehole wall cracks is ¼ to ½ of a wavelength of the microwaves, and a distance between two adjacent borehole wall cracks is ¼ to ½ of the wavelength.

5. The microwave drill bit according to claim 1, wherein the water inlet ring is arranged on an outer wall of the rigid coaxial waveguide, and the water inlet ring is a hollow metal sleeve without an inner wall surface;

the water inlet ring is embedded on an annular groove in the outer wall of the rigid coaxial waveguide, and a connection position between the water inlet ring and the annular groove is sealed by a rubber;

two round holes are formed in upper and lower ends of the water inlet ring respectively, and serve as a water outlet and a water inlet;

the round holes are connected with a cooling water tank at a front end of the equipment moving platform by rigid metal water pipes, and the water inlet ring and the rigid coaxial waveguide are synchronously pushed in a horizontal direction, without rotating;

the rigid coaxial waveguide is symmetrically provided with two round holes along a central plane of the annular groove, and communicates with a cooling channel drilled along the rigid coaxial waveguide outer conductor and the alloy drill bit; and a cooling water in the cooling water tank flows into the water inlet ring from the water inlet, and flows out from the water outlet to enter the cooling water tank after passing through the cooling channel.

6. The microwave drill bit according to claim 1, wherein the microwave splitter I comprises the microwave input end I and two microwave output ends, wherein the two microwave output ends are respectively the microwave output end I and the microwave output end II;

the microwave input end I is divided into ten branches, nine branches are converged to the microwave output end I, and the rest branch is connected with the microwave output end II; and a transmission of the microwaves of the branches is controlled by a branch switch to achieve a power distribution of the microwave output end I and the microwave output end II, and the branch switch is an aluminum metal plate.

7. The microwave drill bit according to claim 1, wherein the microwave splitter II comprises a microwave input end II and two microwave output ends III, wherein the two microwave output ends III are connected with the soft coaxial waveguides respectively; and the microwave input end II is connected with the microwave output end II of the microwave splitter I.

8. A method of fracturing a borehole wall and end of a deep hard rock while drilling and using a microwave drill bit, comprising:

step 1: drilling a monitoring hole in a position 10-20 m from a borehole, and arranging an in-hole radar damage monitoring device in the monitoring hole, wherein the in-hole radar damage monitoring device comprises a cylindrical rod body, a radar signal sensor is arranged at a front end of the cylindrical rod body, and monitors rock mass fracture information at a distance of greater than 20 m in a hole-diameter direction and transmits the rock mass fracture information to a computer through a signal line in the cylindrical rod body, and information of cracks around the borehole at different drilling depths is measured by axially moving the in-hole radar damage monitoring device in the monitoring hole;

step 2: selecting a blank control borehole, opening a water inlet of a cooling water, and starting a rotary drive I, a rotary drive II and heading drives but not switching on a microwave generator, wherein a pushing speed $V_0$ and a drilling speed Ro are fixed, a curve of a pushing force $T_0$ with the drilling depth in a pushing process is monitored, and the information of the cracks around the blank control borehole is tested by the in-hole radar damage monitoring device;

step 3: selecting a microwave borehole, opening the water inlet of the cooling water, starting the rotary drive I, the rotary drive II and the heading drives, opening ten branches of a microwave splitter I, and switching on the microwave generator, wherein a microwave power is continuously increased, and a microwave reflection power is monitored by a reflection power meter to ensure that the microwave reflection power does not exceed a critical reflection power A of the microwave drill bit, the pushing speed $V_0$ is fixed, and when the microwave power reaches a maximum value, a pushing force $T_1$ and the information of the cracks around the borehole in the pushing process are monitored;

step 4: if the pushing force $T_1$ is less than $T_0$, and a number of the cracks around the borehole is increased compared with that without microwaves, continuing operation under this working parameter;

step 5: if the pushing force $T_1$ is equal to $T_0$, but the number of the cracks around the borehole is increased, switching off the microwave generator and the heading drives firstly, then closing one branch connected with a microwave output end I, so as to increase a proportion of the microwave power distributed to a microwave output end II, switching on the microwave generator and the heading drives to continuously increase the microwave power, so as to ensure that the microwave reflection power does not exceed the critical reflection power A of the microwave drill bit, monitoring the pushing force $T_1$ and the information of the cracks around the borehole, if conditions that the pushing force $T_1$ is less than $T_0$ and the number of the cracks around the borehole is increased are not met simultaneously, continuing to additionally closing one branch connected with the microwave output end I, and repeating the operation in the step 5, until the pushing force $T_1$ is less than $T_0$ and the number of the cracks around the borehole is increased; and step 6: if the conditions that the pushing force $T_1$ is less than $T_0$ and the number of the cracks around the borehole is increased are not met simultaneously under conditions in the step 4 and step 5, reducing the pushing speed to ensure that an irradiation time at each point is prolonged, and repeating the operation in the steps 4-6, until the conditions that the pushing force $T_1$ is less than $T_0$ and the number of the cracks around the borehole is increased are realized simultaneously.

* * * * *